US011000731B2

(12) United States Patent
Lindström

(10) Patent No.: US 11,000,731 B2
(45) Date of Patent: May 11, 2021

(54) CROSS-COUNTRY SKIING MACHINE

(71) Applicant: MOTIOFY AB, Sundsvall (SE)

(72) Inventor: Patrik Lindström, Sundsvall (SE)

(73) Assignee: MOTIOFY AB, Sundsvall (SE)

( * ) Notice: Subject to any disclaimer, the term of this patent is extended or adjusted under 35 U.S.C. 154(b) by 0 days.

(21) Appl. No.: 16/630,353

(22) PCT Filed: Jul. 3, 2018

(86) PCT No.: PCT/EP2018/067899

§ 371 (c)(1),
(2) Date: Jan. 10, 2020

(87) PCT Pub. No.: WO2019/011716

PCT Pub. Date: Jan. 17, 2019

(65) Prior Publication Data

US 2020/0179749 A1 Jun. 11, 2020

(30) Foreign Application Priority Data

Jul. 12, 2017 (SE) ..... 1730187-0
Apr. 18, 2018 (SE) ..... 1850438-1

(51) Int. Cl.
*A63B 22/20* (2006.01)
*A63B 21/22* (2006.01)
(Continued)

(52) U.S. Cl.
CPC ..... *A63B 22/203* (2013.01); *A63B 21/225* (2013.01); *A63B 22/001* (2013.01);
(Continued)

(58) Field of Classification Search
CPC ..... A63B 23/1263; A63B 69/18–187; A63B 22/0664; A63B 2022/067–0688
See application file for complete search history.

(56) References Cited

U.S. PATENT DOCUMENTS 3,874,656 A 4/1975 Wintersteller
3,941,377 A 3/1976 Lie
(Continued)

FOREIGN PATENT DOCUMENTS

CH 207538 A 11/1939
DE 568996 C 1/1933
(Continued)

OTHER PUBLICATIONS

International Search Report and Written Opinion of the International Searching Authority Application No. PCT/EP2018/067899 Completed: Sep. 18, 2018; dated Sep. 25, 2018 13 pages.

*Primary Examiner* — Nyca T Nguyen
(74) *Attorney, Agent, or Firm* — Welsh IP Law LLC

(57) ABSTRACT

The present invention relates to a device for physical exercise comprising a pair of skis (2) having a top side and a bottom side, a frame (5), two pendulate arms (19), each of the pendulate arms has an upper end rotatably connected to the frame about a rotational axis, and a lower end pivotably connected to one of the skis, and at least one resistance unit (13, 15) connected to the pendulate arms. The device comprises at least one support parts (1;29;30) located below the skis respectively, and two movable elements (20;26;28) connected to the bottom sides of the skis respectively, and each of the movable elements are arranged linearly movable along one of the support parts.

14 Claims, 17 Drawing Sheets

(51) Int. Cl.
*A63B 22/00* (2006.01)
*A63B 69/18* (2006.01)

(52) U.S. Cl.
CPC ..... *A63B 22/0056* (2013.01); *A63B 69/182* (2013.01); *A63B 2225/093* (2013.01)

(56) References Cited

U.S. PATENT DOCUMENTS 4,023,795 A 5/1977 Pauls
4,434,981 A 3/1984 Norton
4,645,201 A 2/1987 Evans
4,659,077 A 4/1987 Stropkay
4,867,443 A 9/1989 Jensen
5,299,993 A * 4/1994 Habing ..... A63B 21/023 482/51
5,336,141 A * 8/1994 Vittone ..... A63B 22/001 482/130
5,536,225 A 7/1996 Neuberg et al.
5,735,773 A * 4/1998 Vittone ..... A63B 22/001 482/37
5,792,029 A * 8/1998 Gordon ..... A63B 22/001 482/52
5,830,114 A * 11/1998 Halfen ..... A63B 22/203 482/70
5,857,940 A * 1/1999 Husted ..... A63B 21/4047 482/51
6,004,244 A * 12/1999 Simonson ..... A63B 21/153 482/51
6,045,487 A * 4/2000 Miller ..... A63B 21/00178 482/51
6,152,859 A * 11/2000 Stearns ..... A63B 22/0007 482/52
6,302,829 B1 * 10/2001 Schmidt ..... A63B 21/0058 482/51
7,226,390 B2 * 6/2007 Stearns ..... A63B 22/0007 482/51
8,986,167 B2 * 3/2015 Olsen ..... A63B 21/154 482/51
9,072,936 B1 * 7/2015 Miller ..... A63B 21/00069
9,498,672 B1 * 11/2016 Miller ..... A63B 23/03516
9,522,300 B1 * 12/2016 Miller ..... A63B 21/00069
9,649,529 B1 * 5/2017 Miller ..... A63B 22/001
9,907,995 B1 * 3/2018 Miller ..... A63B 22/0664
2004/0092368 A1 * 5/2004 Gramaccioni ..... A63B 22/0064 482/70
2004/0097340 A1 5/2004 Liao et al.
2004/0157706 A1 * 8/2004 Miller ..... A63B 22/0664 482/52
2004/0248705 A1 * 12/2004 Rodgers, Jr. ..... A63B 22/0017 482/83
2004/0248707 A1 * 12/2004 Rodgers, Jr. ..... A63B 22/0664 482/83
2004/0248708 A1 * 12/2004 Rodgers, Jr. ..... A63B 22/001 482/83
2004/0248711 A1 12/2004 Rodgers, Jr.
2005/0107219 A1 * 5/2005 Miller ..... A63B 22/001 482/52
2006/0217234 A1 * 9/2006 Rodgers, Jr. ..... A63B 22/0664 482/52
2006/0276311 A1 * 12/2006 Martin ..... A63B 21/0552 482/92
2007/0037667 A1 2/2007 Gordon
2007/0219062 A1 * 9/2007 Rodgers ..... A63B 22/0056 482/52
2007/0298936 A1 * 12/2007 Ohrt ..... A63B 22/0017 482/52
2010/0144496 A1 * 6/2010 Schmidt ..... A63B 21/4035 482/70
2011/0143884 A1 * 6/2011 Chu ..... A63B 21/225 482/51
2013/0210585 A1 * 8/2013 Arnold ..... A63B 21/0052 482/52
2013/0231217 A1 * 9/2013 Miller ..... A63B 22/0664 482/52
2014/0296036 A1 * 10/2014 Miller ..... A63B 21/008 482/52
2016/0151665 A1 * 6/2016 Miller ..... A63B 23/03591 482/52
2019/0247710 A1 * 8/2019 Unsworth ..... A63B 69/182

FOREIGN PATENT DOCUMENTS

EP 2067504 A1 6/2009
RU 2030195 C1 3/1995
SE 1630008 A1 7/2017
WO 2016205463 A1 12/2016
WO 2017123134 A1 7/2017

* cited by examiner

CROSS-COUNTRY SKIING MACHINE

FIELD OF THE INVENTION

The present invention relates to a device for physical exercise comprising a pair of skis having a top side and a bottom side, a frame, two pendulate arms, each of the pendulate arms has an upper end rotatably connected to the frame about a rotational axis, and a lower end pivotably connected to one of the skis, and at least one resistance unit connected to the pendulate arms.

BACKGROUND OF THE INVENTION AND PRIOR ART

Skiing is a popular and gentle exercise method that provides a good workout for the whole body. The problem is that when there is no snow, there is, except for roller skis, no exercise equipment that sufficiently imitates the entire skiing movement. Skiing is based partly on poling, where one pushes him/herself forward with poles, and by so-called diagonal skiing and double poling, where one with help of the legs pushes away the ski, while at the same time pushing away the pole. Roller skiing is a training method that is regularly used by cross-country skiers and other athletes. However, roller skis have many shortcomings, it is depending on physical conditions, such as road conditions, weather, terrain, etc. In a large city, it can be difficult to find good roads for roller skiing and with all intersecting roads and road users, it can be dangerous to ride roller skis. In addition, poling on hard asphalt may give unwanted strain on back, shoulders and arms.

Over the years, a series of training equipment has been developed to imitate cross-country skiing. A typical construction includes a pair of footplates mounted on a pair of tracks extending along a base frame. The footplates connect to endless belts, which in turn drive a flywheel. There are a number of patents based on similar equipments. For example, U.S. Pat. No. 4,867,443, discloses a device having four parallel gliding rails for feet and poles connected to one resistance unit. The feet of the practitioner are not attached to pendulate arms and therefore the leverage effect from skiing on snow is not simulated.

U.S. Pat. No. 4,659,077, discloses a device having two parallel gliding rails for feet and poles true cords connected to a resistance unit. Also in this device, the feet of the practitioner are not attached to pendulate arms and therefore the leverage effect from skiing on snow is not simulated.

U.S. Pat. Nos. 4,645,201, 4,434,981, 4,023,795, 3,941, 377, disclose similar kind of techniques, and the product, which is currently sold under the trademark Thorax Trainer. U.S. Pat. No. 8,986,167 discloses a device that simulates poling only.

US2007/0037667 discloses a device, whereby the feet of a practitioner are connected to a pendulate. The arms of the pendulate pass at the side of the practitioner, which prevents any natural movement with the arms during practice on this device.

US2004/0097340 discloses a device, whereby the feet of the practitioner are connected to a wheel. This construction prevents horizontal natural movement as in a skiing on snow.

Many exercise devices used today simulate poling more or less well. There is currently no training equipment on the market that imitates the entire skiing movement with poling, diagonal skiing and double poling. Some specialized training facilities have large treadmills that can be used for roller skiing, but they are so big and expensive that they are not suitable for private users or regular gyms. In addition, this equipment is powered by electricity, which is both expensive and can also be difficult to access in some places.

There are some products on the market that simulate poling for cross-country skiing. An example is "Concep2 SkiErg" (www.motion.se), which is built with fan resistors. This is primarily a strength training machine. The similarity to cross-country skiing is low.

Another example of poling equipment is "Thoraxtrainer" (www.thoraxtrainer.com), where the poles are attached to a rack that rolls on rails. The poles cannot be lifted from the rails and thus the correct motion pattern for skiing is not achieved.

Ercolina is a training equipment similar to SkiErg, but here the resistance is magnetic.

None of these poling machines simulate skiing on snow particularly well as they are very monotonous and rigid. The feet are fixed to the ground and it is impossible to get the same forward-leaning position of the body as in skiing on snow, where body and feet move forward. The forward movement makes the practitioner naturally lean forward even during poling compared to when the practitioner is standing still on a floor.

An equipment that provides both arm and leg training is Nordic Track Ski (www.nordictrack.com). One pulls a strap with the arms and moves the legs back and forth. This machine is best suited for diagonal skiing, and not for poling or double poling.

There are also some other similar ski training machines, but today there is no machine on the market, which all classic skiing techniques can be practiced on, and on which the leg and arm movements act against a resistance. There is no training machine, where the poling movement results in one forward movement of the whole body similar to that of skiing on snow. To connect the resistance of arm and leg is important for simulation of normal skiing on snow. During regular skiing, one usually poles, when the slope is easy (flat) and adds the pushing with the legs, when the slope is uphill.

SUMMARY OF THE INVENTION

It is an object of the present invention to at least partly overcome the above problems, and to provide an improved device for physical exercise, especially a device that can be used for simulating/imitating cross-country skiing.

This object is achieved by a device as defined in claim 1, which is a device for physical exercise comprising or consists of a pair of skis having a top side and a bottom side, a frame, two pendulate arms, each of the pendulate arms has an upper end rotatably connected to the frame about a rotational axis, and a lower end pivotably connected to one of the skis, and at least one resistance unit connected to the pendulate arms.

The device comprises at least one support part located below the skis respectively, and two movable elements connected to the bottom sides of the skis respectively, and each of the movable elements are arranged linearly movable along one of the support parts. The device may have two support parts, one for each ski. The support parts may be elongated.

In one aspect, said support parts are gliding rails arranged with a longitudinal axis in parallel with a longitudinal axis of the skis.

In another aspect, said movable elements are arranged to glide or roll on the support parts. Depending on the shape of the support parts, the angle of the ski can either be 180°, i.e. horizontal throughout the whole pendulum movement or the support part can be shaped in a way such that the practitioner gets a desired leaning on the skis during training.

With this new device natural skiing on snow is simulated because the whole body, e.g. arms, stomach, hips, legs, are being trained in the same way as during cross-country skiing. As the practitioner is with margins behind or in front of the pendulate arms, there is enough space to perform the entire pole movement, such as in classic cross-country skiing. The leverage of the pendulate arm allows the skis to continue to move easily and drive the resistance unit even at high loads. The skis may operate with or without resistance. Without resistance the practitioner can still get a natural skiing movement (See FIG. 5, 6, 7). The device allows a natural forward leaning of the body as in skiing on snow.

In a further aspect, a raiseable rail is pivotally attached to a front end of the skis, such that the rail can be raised from the skis when gliding or rolling over the support parts. The raiseable rail may be pivotally attached to the top side of the skis on a front end of the skis. The raiseable rail allows the feet of the practitioner to be lifted from the skis. This allows the body to lean even more forward during training and thus improves simulation of skiing on snow.

In an aspect, the device comprises a pair of first cords connecting the pendulate arms with the resistance unit and each of the first cords is adjustably attached to one of the pendulate arms to enable a connection point between the cord and the pendulate arm to be raised and lowered along the pendulate arm. When the cord is connected to pendulate arms, the pendulate arms provide a leverage that provides a greater force on the ski than the arms. Depending on where the cord is connected on the pendulate arms, the leverage effect and hence the resistance can be varied. The resistance on the skis is reduced when the cord is connected at a position high up on the pendulate arms in a vertical direction (i.e. in the proximity of the rotation axis). If, on the other hand, the cord is connected far down on the pendulate arms, the resistance on the skis increases.

In one aspect, the first cords extend from the connection point on pendulate, to or up between a pair of first wheels mounted at a lower end on the frame and positioned vertically under the axis of the pendulate arms thereafter upwards over a pair of second wheels at an upper end of the pendulate arms and therefrom to the at least one resistance unit. The wheels improve control of the resistance on the skis during training.

In another aspect, the first cords extend from the connection point on pendulate arms to/up between the pair of first wheels mounted at a lower end on the frame positioned vertically under said rotational axis thereafter upwards to/over the pair of second wheels via said rotational axis, and the first cords from the two pendulate arms then become a common cord continuing to the resistance unit. The movement forwards and backwards of the skis is the same with help of the common cord.

In an aspect, the first cords extend from the connection point on the pendulate arms down to/between the pair of first wheels mounted at an upper end on the frame positioned vertically under said rotational axis thereafter downwards over second wheels at a bottom of frame and then continuing to the at least one resistance unit.

In another aspect, the first cords extend from the connection point on the pendulate arms up between the pair of first wheels mounted at an upper end of the frame positioned vertically under said rotational axis thereafter to the at least one resistance unit.

In a further aspect, the position of the attachments of the pair of first wheels on the frame are individually adjustable in height along a length of the frame. The adjustable wheels allow the resistance on the skis to be varied during training. The different positions of the wheels allow for example the resistance on the forward movement of the ski to be less than the resistance on the backwards movement of the ski, because the leverage is larger when the pendulate arm pulls the cord forward.

In an aspect, the position of the attachments of the pair of first wheels on the frame are individually laterally adjustable both behind and in front of a vertical position of the pendulate arm or the rotational axis. The laterally adjustable wheels allow the resistance on the skis to be varied during training. The backwards resistance on the ski also occurs later, when the wheel is positioned in a lateral position in front of the rotational axis of the pendulate arms.

In one aspect, the device comprises a pair of pole handles, a pair of second cords connecting the pole handles to the at least one resistance unit, a pair of second wheels arranged at said rotational axis of an upper ends of the pendulate arms, wherein each of the second cords extend from one of the pole handles via one of the pair of second wheels to the at least one resistance unit. At one pole strike, the pole handles move from a position diagonally in front of the body with the hands approximately at eye level, and with a starting position slightly wider than shoulder width. The pole handles then moves in a reciprocating motion down to the knees next to and/or diagonally behind the body, while the practitioner bends the upper body forward. The new device thus simulated the skiing movement on snow.

Due to the fact that both skis and pole handles are each separately connected to the flywheel, a movement is created that is very similar to that of classic cross-country skiing on snow. Each pole handle and ski individually affect the flywheel and its rotational speed. It is possible, for example, to drive the flywheel by pivoting the skis, while at the same time pivoting the arms, so-called diagonal skiing. It is also possible to stand still with the skis and only drive the flywheel with the pole handles. The resistance that occurs when poling automatically causes the skis to be pivoted forward as shown in FIGS. 5 to 7. This allows the practitioner to get a more forward-leaning position compared to standing still and exercising on a poling machine, where feet are fixed to the ground. The forward movement and the forward-leaning position are similar to those when skiing on snow and creates a natural feeling when poling.

In another aspect, the device comprises two gliding rails, and each of the gliding rails are mounted on an outside of or laterally in respect to the pendulate arms and parallel to the swing direction of the pendulate arms. For simulation of natural cross skiing, the pole handles need to be positioned laterally next to the skis and the arms need to be able to move freely.

In a further aspect, the device comprises a rear and a front pulley with a connecting endless belt and mounted at the ends of each of the gliding rails. Instead of connecting the pole handles via a second cord to the resistance units, the endless belt can be used to connect the pole handles to the resistance unit. This may provide a more natural feeling and thus improve simulation of skiing on snow.

In an aspect, the pole handles are pivotably and rotatably mounted on gliding elements with their tips, adapted to glide along the gliding rails and endless belt, so that when the belt is actuated by a pulling force in the rearward direction, the at least one resistance unit is activated. This construction with rails side by side to the pendulate arms may provide a more compact machine that is less spacy. In one aspect, the at least one resistance unit comprises at least one freewheel hub connecting each of the first and/or second cords or rear and/or front pulleys with at least one drive shaft, wherein movement of the cords and/or endless belt in one direction drives at least one flywheel to move in the opposite direction.

In another aspect, the at least one resistance unit drives at least one flywheel, fan, centrifugal fan and/or magnetic resistance. The resistance unit may comprise a combination of different types of resistances, such as one or two flywheel combined with a fan and/or magnetic resistance. Each of the resistance units may have a freewheel.

In a further aspect, the first and/or second cords are detachable connected to the resistance unit. This improves flexibility for the user in use of the device. The stabbing/poling skiing movement can be performed even when the first cords is disconnected from the pendulate arms. The skis then turn in to free gliding elements allowing the skier a movement with the legs that is needed.

In one aspect, the distance between the feet and the lower end of the pendulate arms is between 0.2 and 3 meters.

BRIEF DESCRIPTION OF THE DRAWINGS

The invention will now be explained more closely by the description of different aspects of the invention and with reference to the appended figures.

DETAILED DESCRIPTION OF VARIOUS ASPECTS OF THE INVENTION

Figure 1:
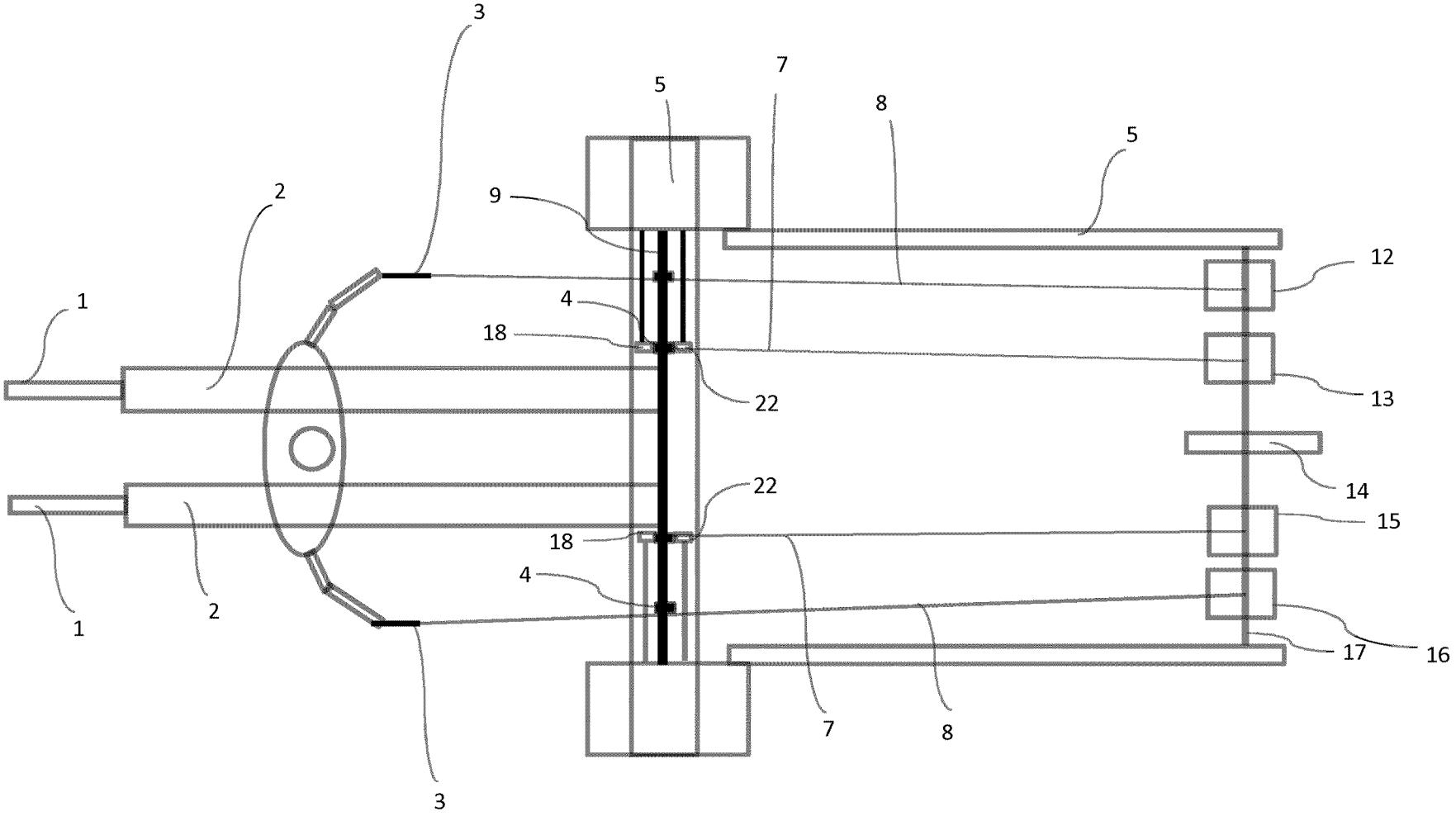
FIG. 1 shows a top view of an aspect of the invention in its initial position.

Terms, such as increased, reduced, larger, as used herein are relative terms comparing an values with a starting or middle position, (e.g. resistance) unless expressly stated otherwise.

The figures show a device for physical exercise. The device comprises or consists of a frame 5 supporting a crossing support element 9, which supports the pendulate arms 19. Pendulate arms 19 are each rotatably connected to skis 2.

The pair of skis 2 have a top side and a bottom side and may be connected to the pendulate arm 19 at a front side or a back side of the skis 2.

Figure 2:
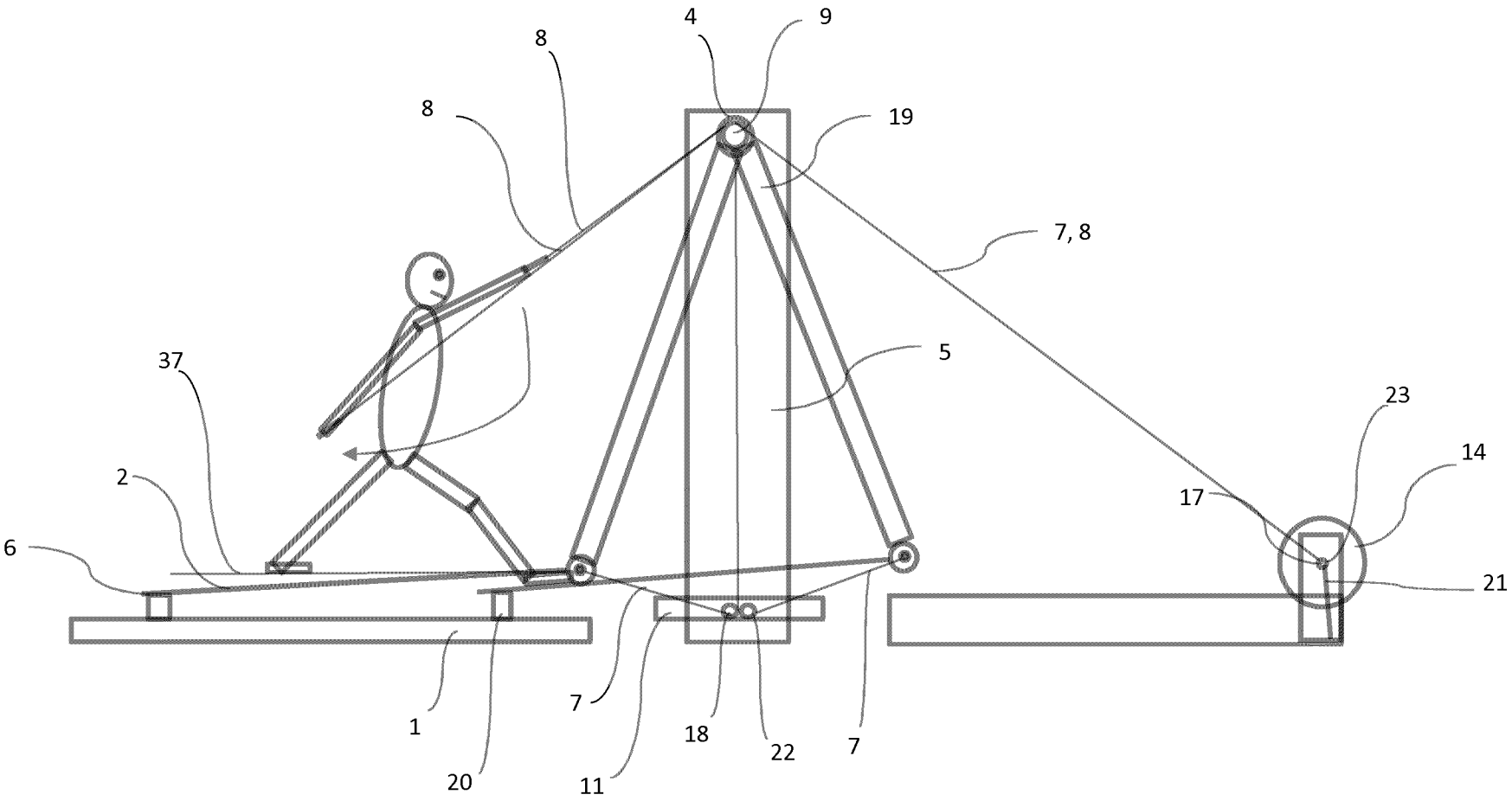
FIG. 2 shows the aspect of the invention from the side, when the practitioner performs diagonal skiing and where the cord from the skis runs between wheels such that the resistance for pushing back is similar to that of pushing forwards. The arrow indicates movements of the arms of the user.
Figure 10:
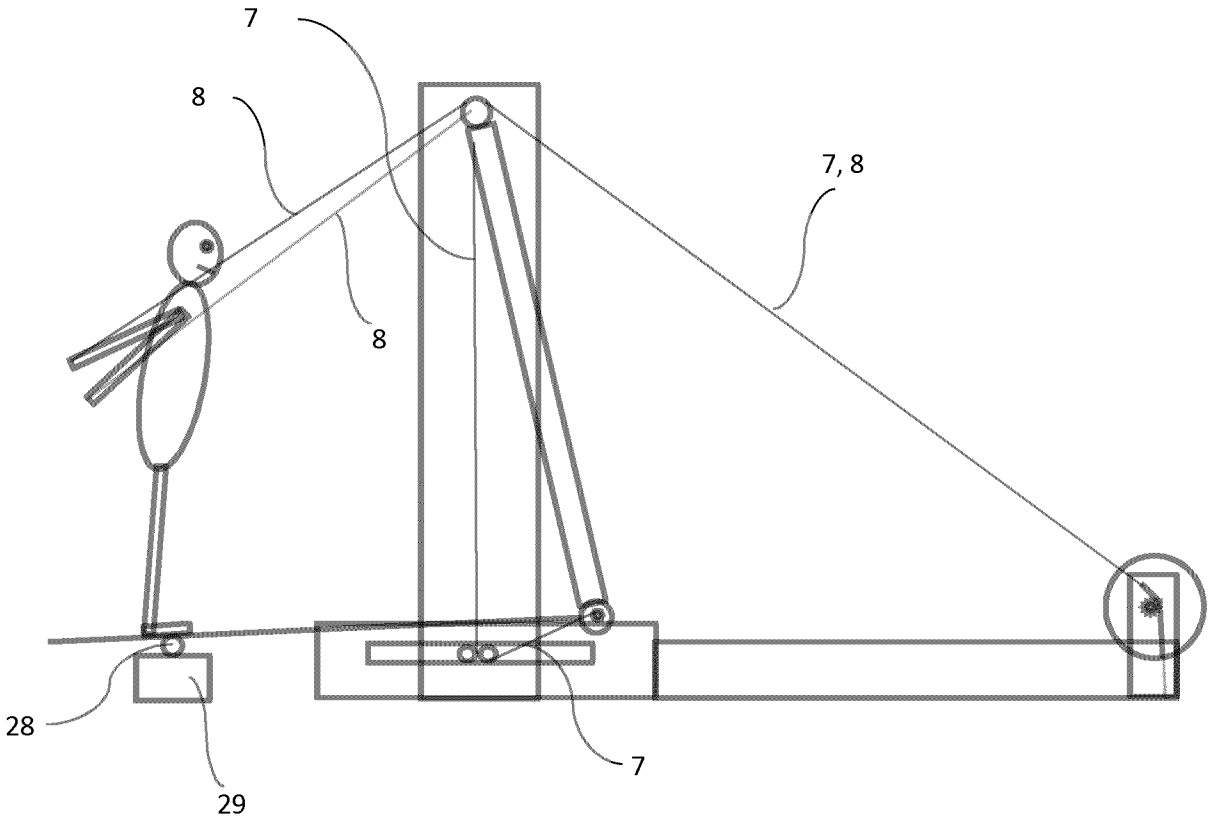
FIG. 10 shows an alternative aspect of the invention, where the skis instead of gliding over a rail, glide on fixed wheels.
Figure 11:
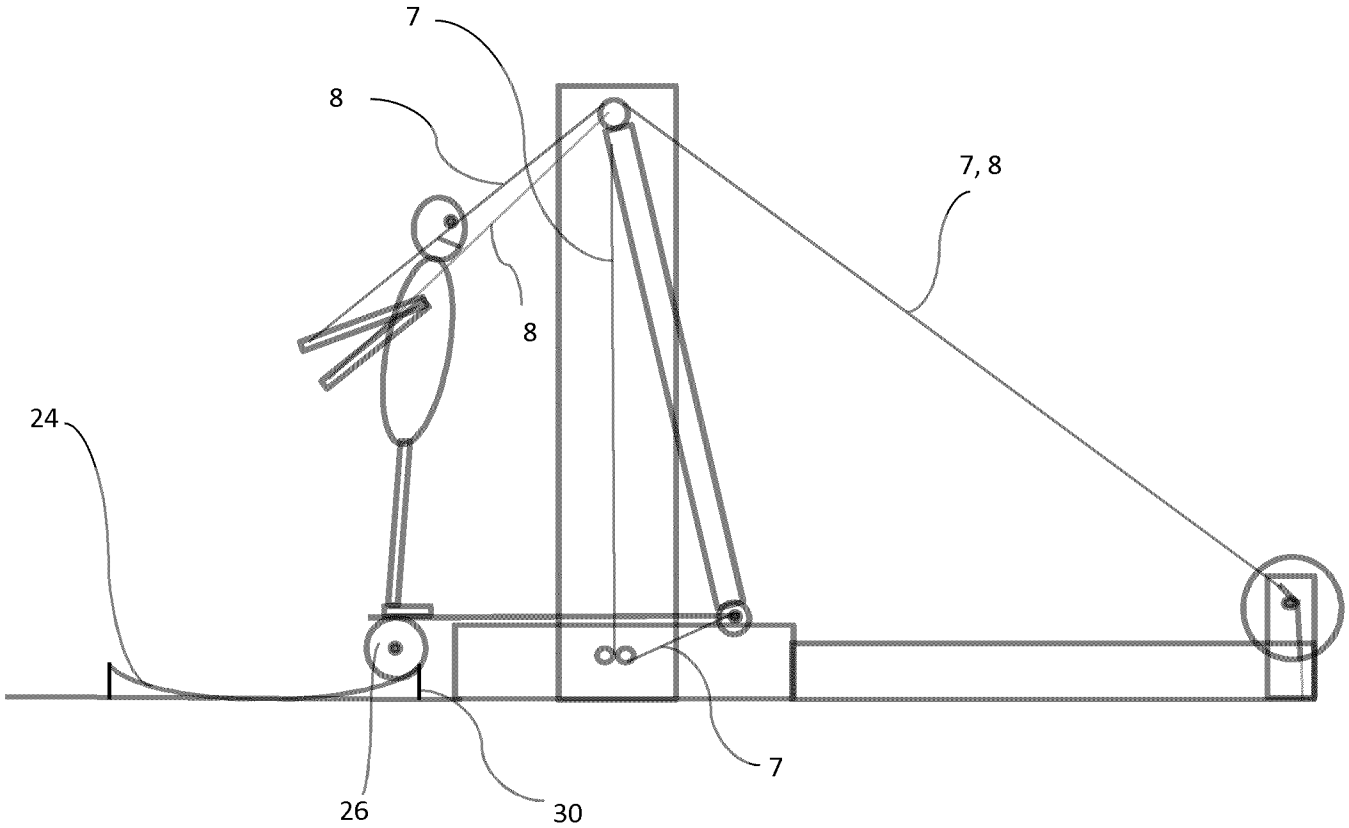
FIG. 11 illustrates an alternative aspect of the invention from the side, where wheels attached to skis are rolling on a circular shaped rail.

Two movable elements 20;26;28 are connected to the bottom sides of the skis respectively. Each of the movable elements are arranged linearly movable along a support part 1;29;30. The support parts 1;29;30 are located under the skis 2. The support parts may be elongated. The movable elements 20;26;28 are arranged to glide or roll on the support parts. As shown in FIG. 2, the support parts 1 are gliding rails arranged with a longitudinal axis in parallel with a longitudinal axis of the skis 2. The movable element 20 is attached to the bottom side of the ski 2 and glides over the rails 1. A rotatable wheel 6 may be present between the movable element and the bottom side of the ski 2. As shown in FIG. 10, the support part 29 is a block and the movable elements is a wheel 28 fixedly attached to support part 29 over which the skis 2 roll. FIG. 11, 13 shows a support part 30, which may be a rail 24 and which may have a circular shape as shown in FIG. 11, 13. The movable element 26 is a wheel that may be attached to the bottom side of the ski 2.

The movable element allows the practitioner to move the skis forward and backwards over the support parts 1;29;30 during skiing on the device. The steepness of the gliding rail or circular shaped support part may be varied to vary the angle of the skis in relation to the horizontal axis of the floor on which the device is placed. This allows varying the resistance of the skis during exercise.

Because skis 2 can either glide along a gliding rail 36 or, for example, roll with wheels 26 on a circular rail 24, the practitioner can vary the velocity of the pendulate arms by means of varying steepness of the support part or the leaning of the movable element. The practitioner's weight naturally causes the pendulate arms to return to its vertical starting position. If the rear part of the gliding rail 1 or circular rail 24 is raised, the ski 2 and gliding element 20 or wheel 26 will, upon return, need to push upwards to the raised rails 1, 24. The pendulate arms return after pivoting will then be slower compared to a straight flat rail. On the contrary, if the front part of the gliding rail 1 or circular rail 24 is raised, the return of the pendulate arms will be faster compared to a straight flat rail as the gliding element 20 of the gliding rail 1 or wheel 26 gets "downhill" and the pendulate arms with practitioner falls faster back to the starting position.

As shown in FIG. 2, a raiseable rail 37 may be pivotally attached to the skis 2 on a front side of the skis, or on the front side and top side of the skis. This allows the rail 37 to be raised from the skis when gliding or rolling over the support parts 1;29;30.

Bindings may be attached or mounted on the skis or raiseable rail 37. Any type of binding can be used for this purpose, such as clips, strips or straps to removably attach jogging shoes or ski boots.

Figure 12:
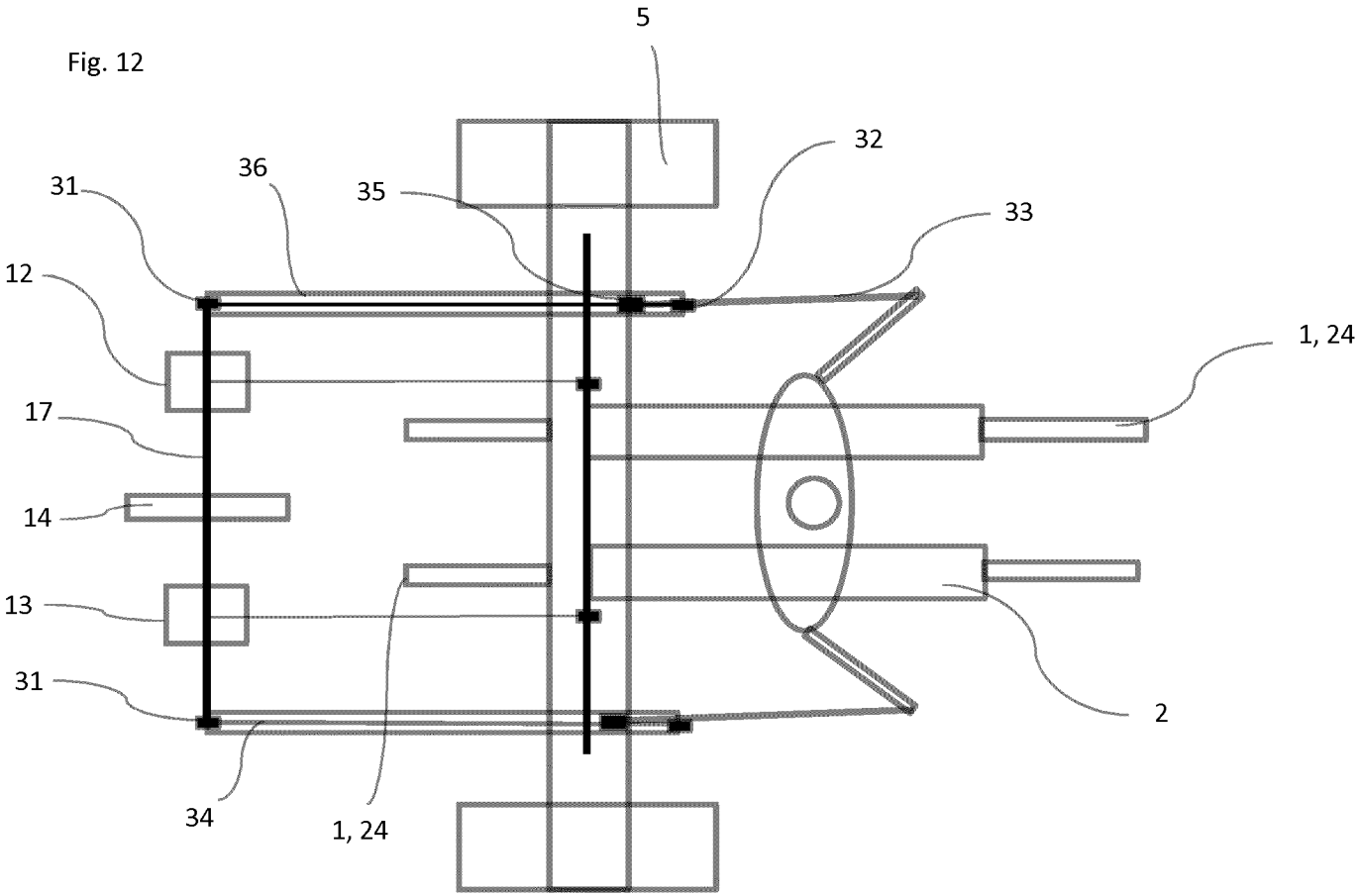
FIG. 12 shows an alternative aspect of the invention, where the pendulate arm is attached to the back side of the ski instead of to the front side and where the practitioner poles with poles attached to a glide element on a gliding rail, which drives the freewheel.

The two pendulate arms 19 comprise each an upper end rotatably connected to the frame 5 about a rotational axis and a lower end pivotably connected to the skis. The pendulate arm 19 may be connected on the front side of the skis as shown in FIGS. 1 to 7. The pendulate arm 19 may also be connected to the back side of the skis 2 as show in FIGS. 12 to 13.

The distance between the feet or a front side of the feet and the lower end of the pendulate arms is such that the practitioner has freedom to perform the skiing movement without being hindered by the pendulate arms, frame or cords. The distance may be between 0.2 and 3, or 0.3 to 2, or 0.4 to 1.5, or 0.5 to 1 meters.

At least one resistance unit 13, 15 is connected to the pendulate arms so that a resistance occurs when the skis 2 are pushed apart in the longitudinal direction of the skis.

Figure 8:
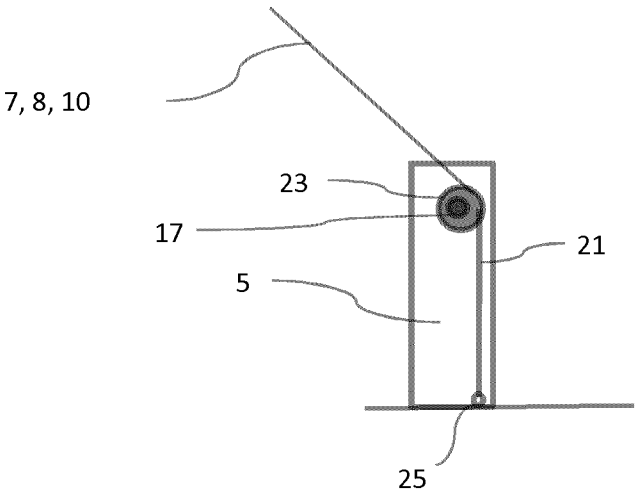
FIG. 8 illustrates a schematic view of a resistance unit.

The pendulate arms 19 are connected to the resistance unit by a pair of first cord 7. The resistance unit 13, 15 drives at least one flywheel, fan, centrifugal fan and/or magnetic resistance 14. The pendulate arms 19 may be connected directly to a drive shaft 17 of the flywheel 14 via first cords 7 and drive the flywheel 14 through the least one resistance units 13, 15. The resistance unit comprises or consist of the drive shaft 17, a freewheel hub 23 with freewheel function mounted on drive shaft 17, a spring, elastic band or coil 21, which is at one end attached to a loop 25 and at the other end attached to the first cord 7. (FIG. 8). It should be noted that the flywheel, fan, centrifugal fan and/or magnetic resistance 14 may be formed as an integral unit of the resistance unit 12, 13, 15, 16.

The first cord 7 is coiled on the freewheel hub 23, such that when first cord 7 is pulled out, the drive shaft 17 starts to rotate and wind up the cord. The first cord 7 is retracted to its start position by the spring or elastic band 21. The spring or elastic band 21 strives to hold a predetermined tension in first cord 7.

Figure 3:
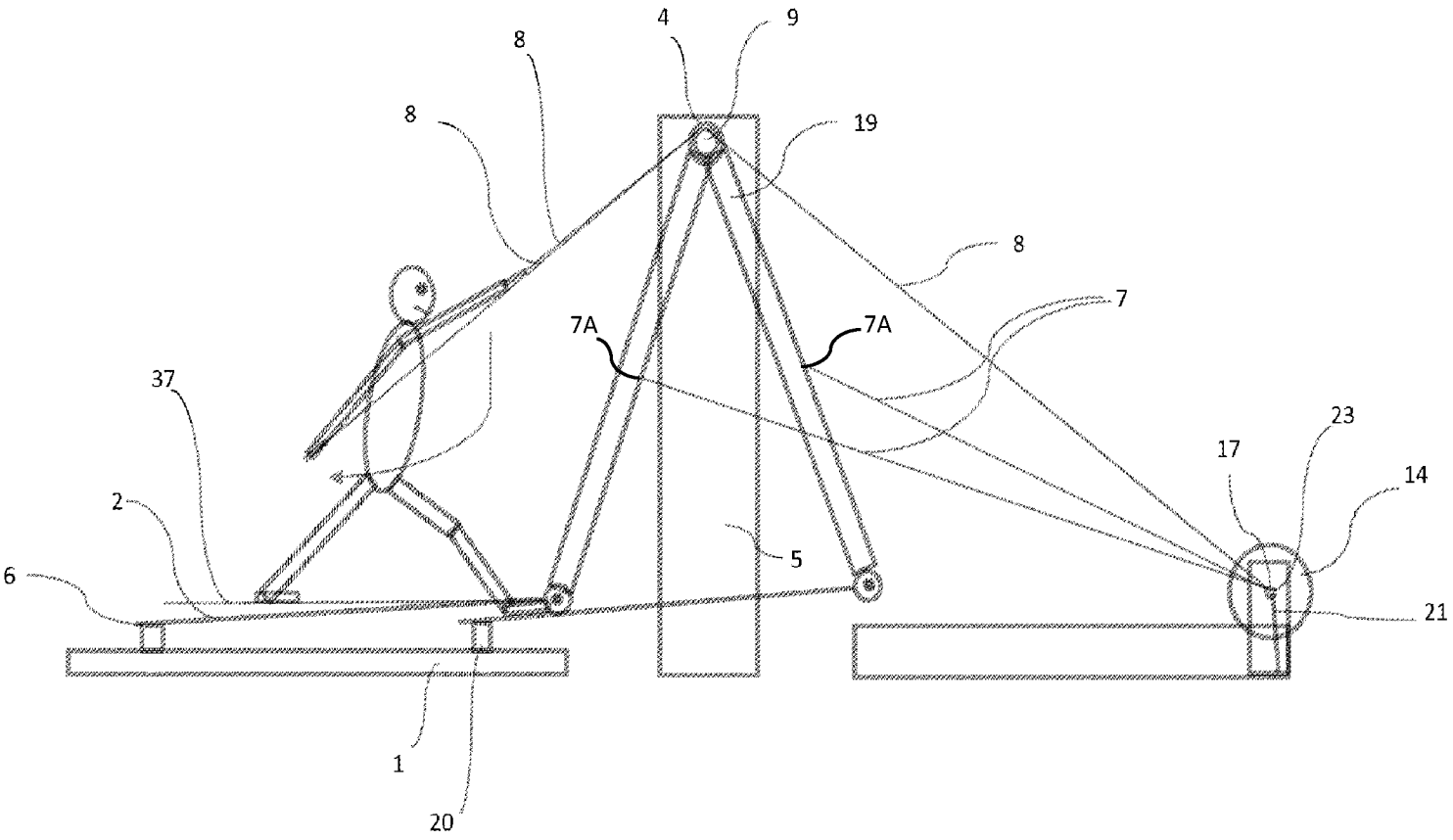
FIG. 3 shows an aspect of the invention from the side, when the practitioner performs diagonal skiing and where the cord runs from a resistance unit to a height of choice along the pendulate arms.

First cords 7 may be adjustably attached to the pendulate arms to enable a connection point between the resistance unit 13,15 and each of the pendulate arms. The first cord 7 may be connected so that it extends directly from the pendulate arms 19 to a drive shaft 17 as shown in FIG. 3.

First cords 7 may be adjustably attached to the frame 5 to enable a connection point 7A between the resistance unit 13,15 and each of the pendulate arms.

The first cords 7 may extend from the connection point on pendulate arms 19 along the pendulate arms 19 up between a pair of first wheels 18, 22 mounted on the frame 5.

As the first cords 7 pass through first wheels 18, 22, the first cords are pulled out both when skis 2 are pivoted forwards and backwards.

The wheels 18, 22 may be positioned vertically under the rotational axis of the pendulate arms 19, whereby the first cord 7 passes through the pair of first wheels 18, 22 at a lower end of the frame 5 and thereafter continue upwards through a pair of second wheels 4 at an upper end of the pendulate arms and from there continue to the at least one resistance unit 13, 15 as shown in FIG. 2. Alternatively, the first cords 7 may extend from the connection point on the pendulate arms along the pendulate arms down between the pair of first wheels 18, 22 mounted on the frame 5 positioned vertically under said rotational axis at the upper end of the pendulate arms or frame 5 and thereafter continue downwards over the pair of second wheels 4 at a bottom of frame and then continue to the at least one resistance unit. In a further alternative, the cord continues from the pair of first wheels 18, 22 directly to the at least one resistance unit. The variation in height of the attachment of the first cord 7 to the frame 5 or pendulate arm 19 allows the resistance to be varied by the force of the leverage effect. The leverage effect is different depending on where the first cord 7 is attached to the pendulate arm 19 and where each of the pair of first wheels 18, 22 are attached to the frame 5. If the pair of first wheels 18, 22 are connected on the frame 5 or the pendulate arm 19 in the proximity of the rotational axis, a larger leverage effect and a reduced resistance is obtained compared to when the pair of first wheels 18, 22 are attached far down on the frame 5 or the pendulate arm 19 in the proximity of the skis, where leverage effect is reduced and the resistance increased.

Figure 4:
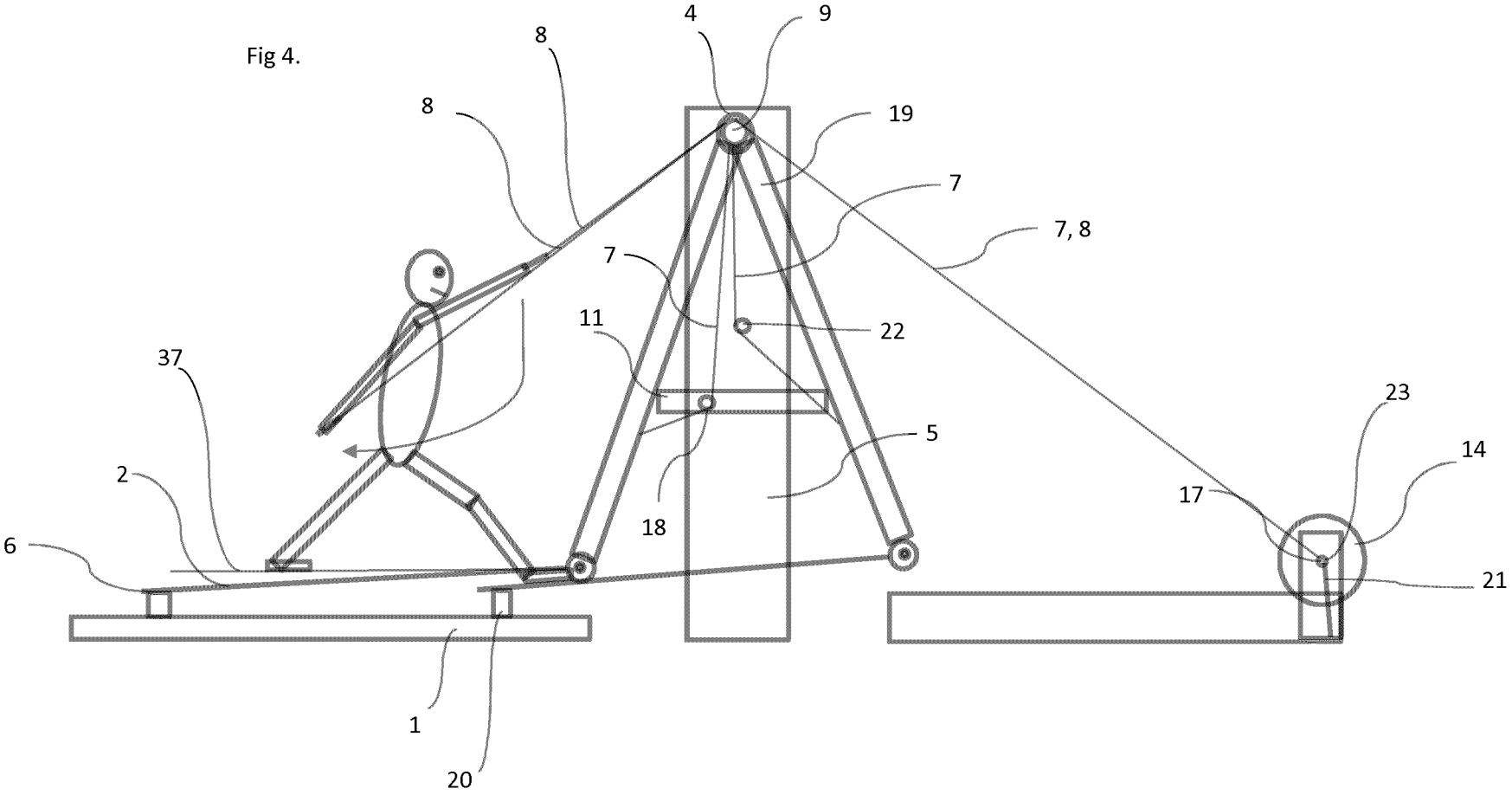
FIG. 4 shows an aspect of the invention from the side, when the practitioner performs diagonal skiing and where the cords run to/between wheels such that the resistance when pushing back is larger than the resistance when pushing forward.

The wheels may be positioned on the frame 5 in different ways to vary the resistance for the practitioner during skiing as shown in FIGS. 2 and 4. As shown in FIG. 4, the pair of first wheels 18, 22 do not need to be positioned next to each other in a horizontal direction along the longitudinal axis of the skis. For example, if one of the first wheel 18 is positioned closer to the bottom of the frame 5 than the another of the first wheel 22, e.g. at the level of the skies, the leverage effect is reduced compared to when the wheels are in parallel in a horizontal direction. In FIG. 4, the resistance of the movement backwards with the ski 2 will be increased when the cord 7 is pulled out. If, at the same time, another of the first wheel 22 is attached to the frame 5, e.g. in the proximity of the rotational axis, the forward movement of the ski will have an increased leverage effect and reduced resistance when the first cord 7 being pulled out.

The position of the pair of first wheels 18, 22 can also be varied in a lateral direction, i.e. in front or behind the rotational axis of the pendulate arm 19 along the longitudinal axis of the skis. If the pair of first wheels 18, 22 are mounted closer to the skier, it will cause no direct resistance to the skier in the ski 2 that is pivoted backwards. Instead, the resistance will be directly on the ski 2 that is pivoted forwards. Similarly, when the pair of first wheels 18, 22 are positioned further away from the skier, there will be more resistance in the back push and less in the forward push. If the pair of wheels 18, 22 are placed in line with the vertical starting position of pendulate arm, resistance occurs directly at the backwards push as well as forward push of the respective ski. This is because the starting position of the pendulate arm 19, with help of the user's weight, is vertical and when the pair of first wheels 18, 22, for example, are behind the rotational axis in a longitudinal direction in relation to the skis, the first cord 7 will first be pulled in when the pendulate arm passes the pair of first wheels 18, 22 and then the first cords 7 is pulled out again.

Figure 9:
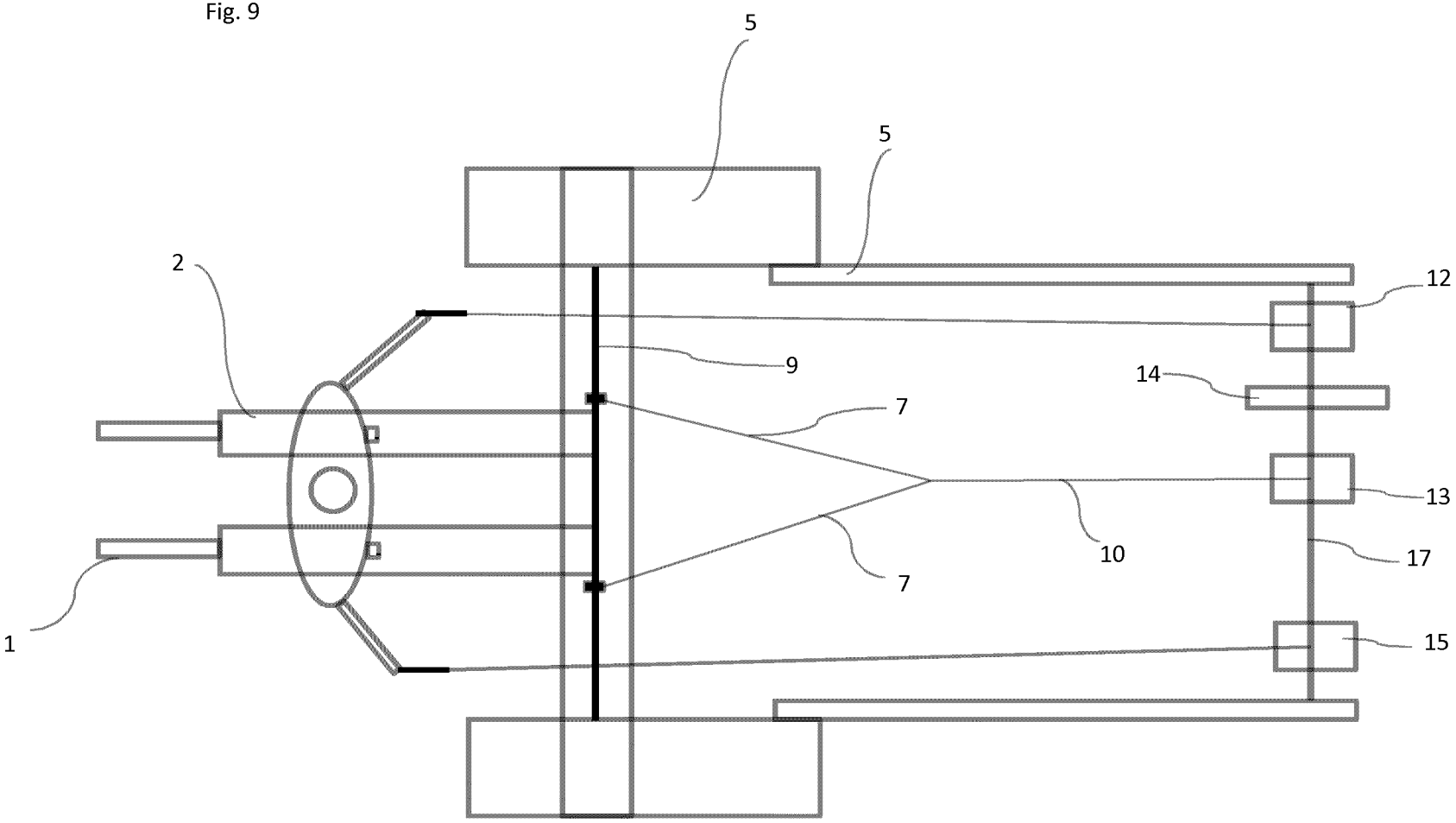
FIG. 9 illustrates an alternative aspect of the invention from above, where the first cords from the skis join to a common cord.

The first cords 7 may be connected to a common cord 10 as shown in FIG. 9. The first cords 7 continue from the two pendulate arms 19 to become a common cord 10. When the skis 2 pivot, a right ski 2 will move forward as much as a left ski 2 moves backwards. Common cord 10 is connected to the resistance unit 13.

The first cords 7 may be disconnected from the resistance 13, 15.

The device may comprise a pair of pole handles 3 and a pair of second cords 8 connecting the pole handles to the at least one resistance unit 12, 16. In this aspect, the cord 8 runs over the pair of second wheels 4 arranged at or in the proximity of said rotational axis at the upper ends of the pendulate arms 19. Each of the second cords 8 extend from one of the pole handles 3 via one of the pair of second wheels 4 to the at least one resistance unit 12, 16.

When the practitioner performs a poling movement, and pulls second cord 8 backwards, the velocity of the flywheel 14 increases. When the arms are moved forward for a new pull with handle/pole handle 3, the second cord 8 is pulled in again without affecting the speed of flywheel 14.

The second cords 8 may be disconnected from the resistance 12, 16.

The pole handles may be real poles 3. A top of each pole 3 may be pivotally attached to a gliding element 35, which glides along a gliding rail 36. The gliding rails 36 are mounted on an outside of one of the pendulate arms 19 in a lateral direction and parallel to the swing direction of the pendulate arms 19. The poles 3 may be attached to the gliding element 35 so that the angle of the pole 3 in relation to the gliding rail 36 can be varied in relation to the rails, thereby naturally following the practitioner's position during the skiing movement.

The device may comprise a rear 31 and a front 32 pulley with connecting endless belt 34 and mounted at the ends of each of the gliding rails 36.

Figure 13:
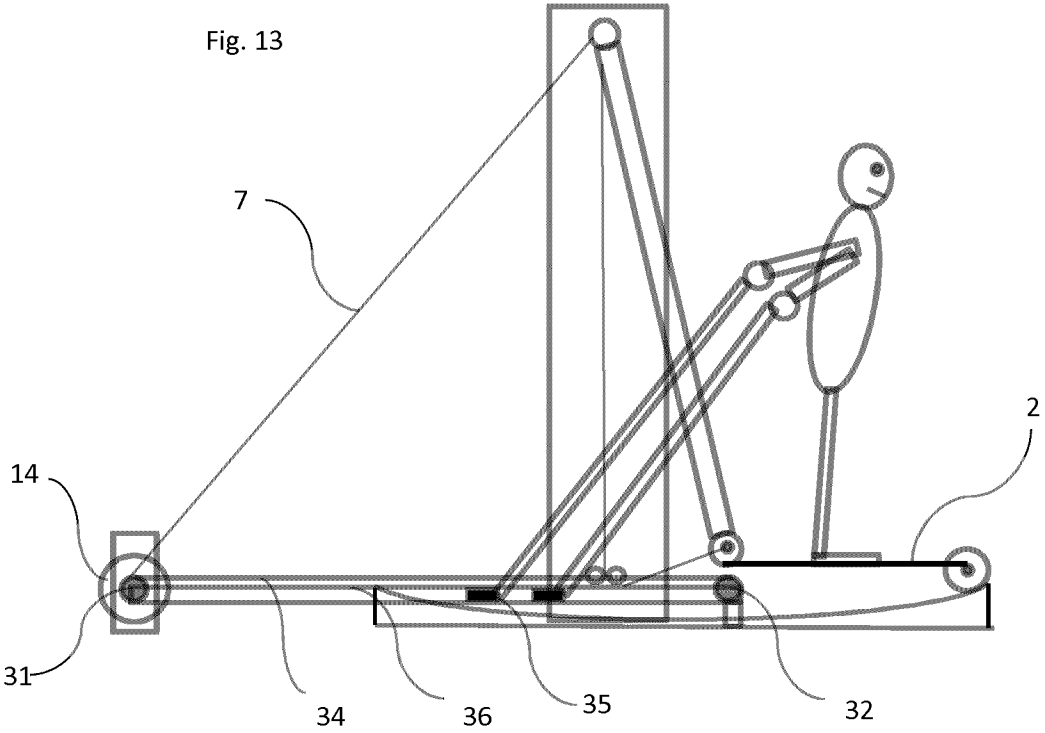
FIG. 13 shows a side view of the aspect in FIG. 12.
Figure 14:
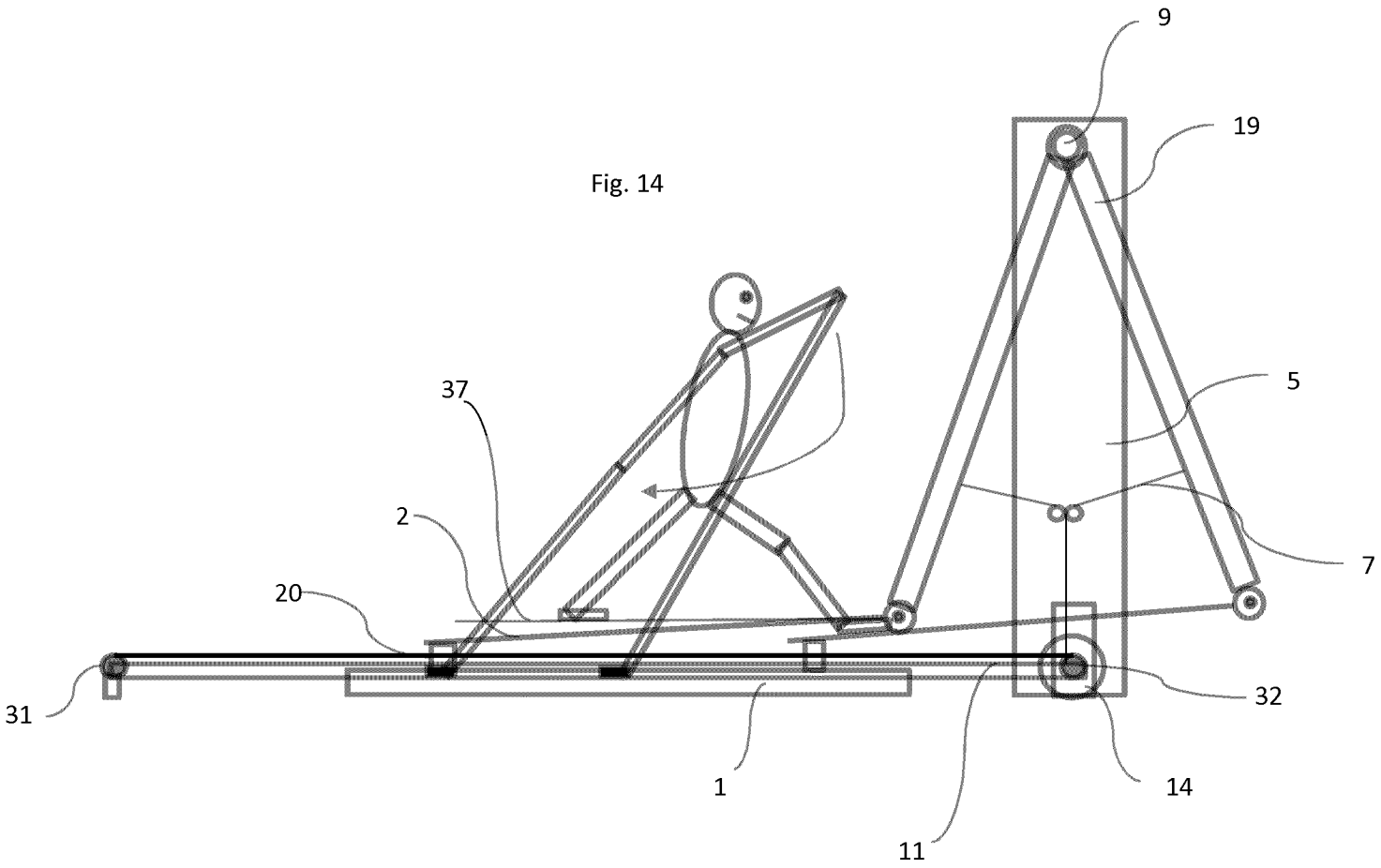
FIG. 14 shows an alternative aspect with poles attached to a gliding rail, where the pendulate arm are connected to the front side of the skis.

As shown in FIGS. 13 and 14, the pole handles 3 may be pivotably and rotatably mounted on gliding elements 35 with their tips and adapted to glide along the gliding rails 36 and an endless belt 34, so that when the belt is actuated by a pulling force in the rearward direction, the at least one resistance unit 12, 16 is activated. At both ends of gliding rails, there may be pulleys 31, 32 connected to an endless belt 34. The at least one freewheel hub 23 of the resistance unit connects each of the first and/or second cords 7, 8 or rear and/or front pulleys 31, 32 with at least one drive shaft 17. The pole handles 3 drive the endless belt 34, the drive shaft 17 and the flywheel 14 when they are pushed backward by the practitioner. Movement of the first cords 7, and/or second cord 8 or the endless belt 34 in one direction drives at least one flywheel 14 in the opposite direction. The speed of the flywheel 14 is not affected, when the pole handles 3 together with endless belt 34 are thereafter pushed forward for a new pole strike.

By varying the size of freewheel hubs 23, the gear ratio can be varied. If the freewheel hubs 23 of the resistance unit 13, 15, which are connected to the skis, have a smaller diameter than the freewheel hubs 23 of resistance units 12, 16, which are connected to the pole handle 3, the resistance on the movement of the skis is larger compared to the resistance on the movement of the pole handles 3. The skis then affect the flywheel with greater force compared to when skis 2 and pole handle 3 are connected to equally sized freewheel hubs 23.

The gear ratio effecting the resistance 12, 13, 15, 16 can also be varied by attaching the freewheel or resistance to a second shaft (not shown), which through an endless belt and pulleys is connected to the driveshaft 17. The size of the pulleys can be varied to vary the gear ratio and power to the flywheel.

Figure 5:
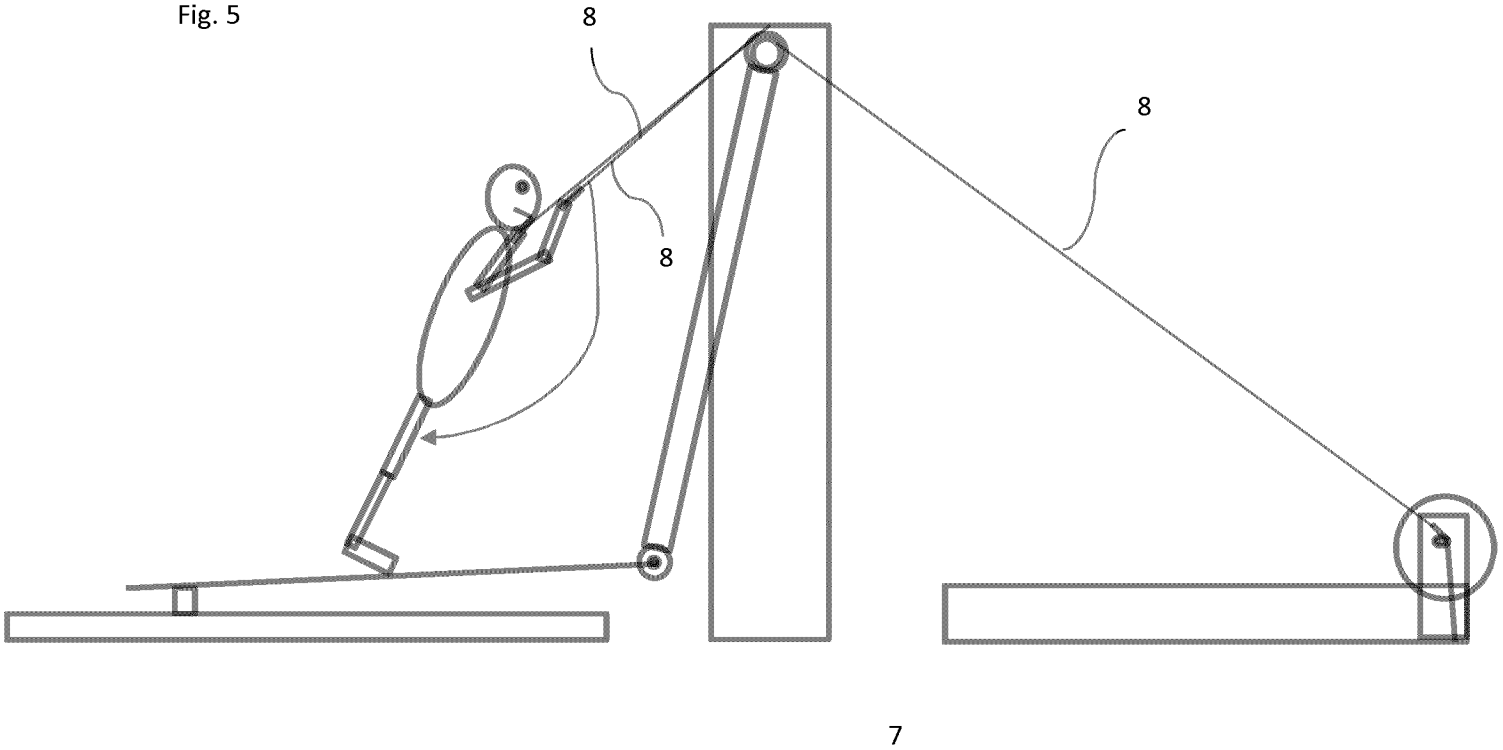
FIG. 5 shows an aspect of the invention from the side, when the practitioner performs poling at the start of the poling movement, where the practitioner, by leaning forward, first moves backwards with the skis and then when poling moves forward.
Figure 6:
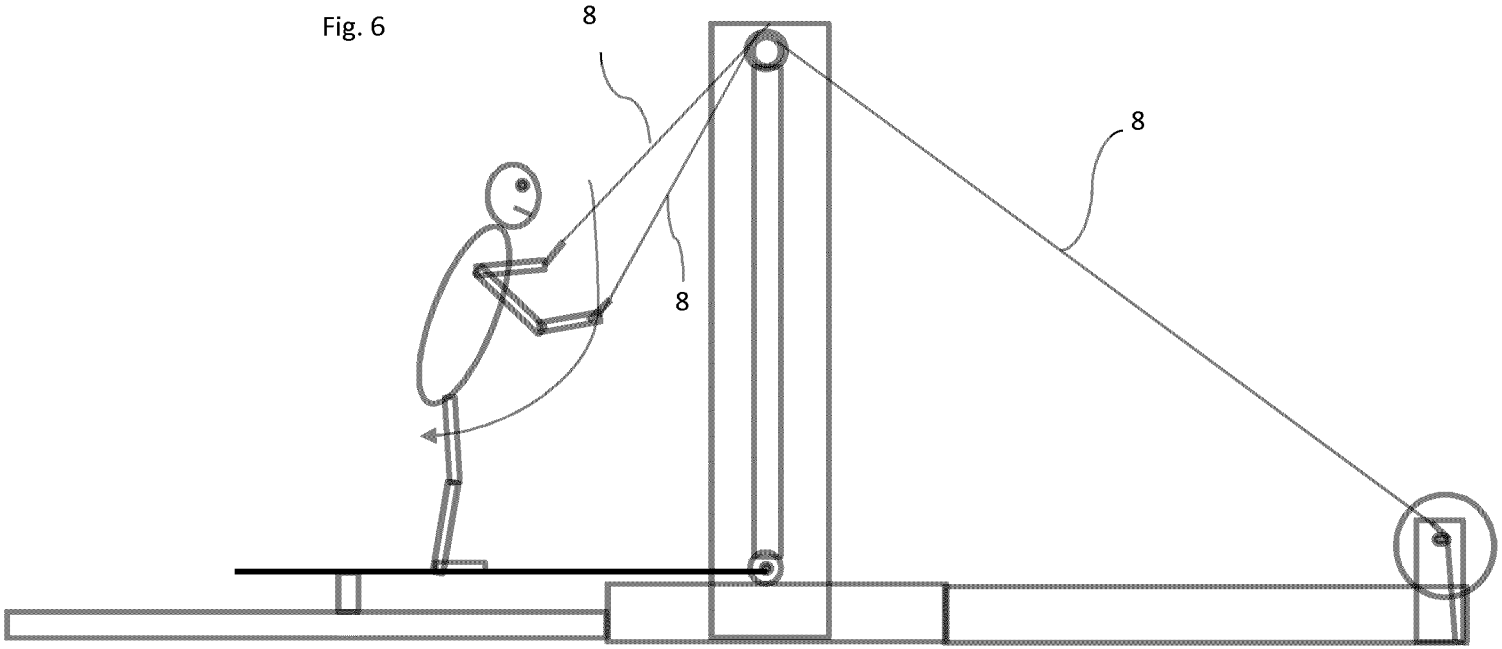
FIG. 6 shows an aspect of the invention from the side, when the practitioner performs poling in the middle of the poling movement and the practitioner acquires a forward leaning position because of the resistance. The arrow indicates the movement of the arms.
Figure 7:
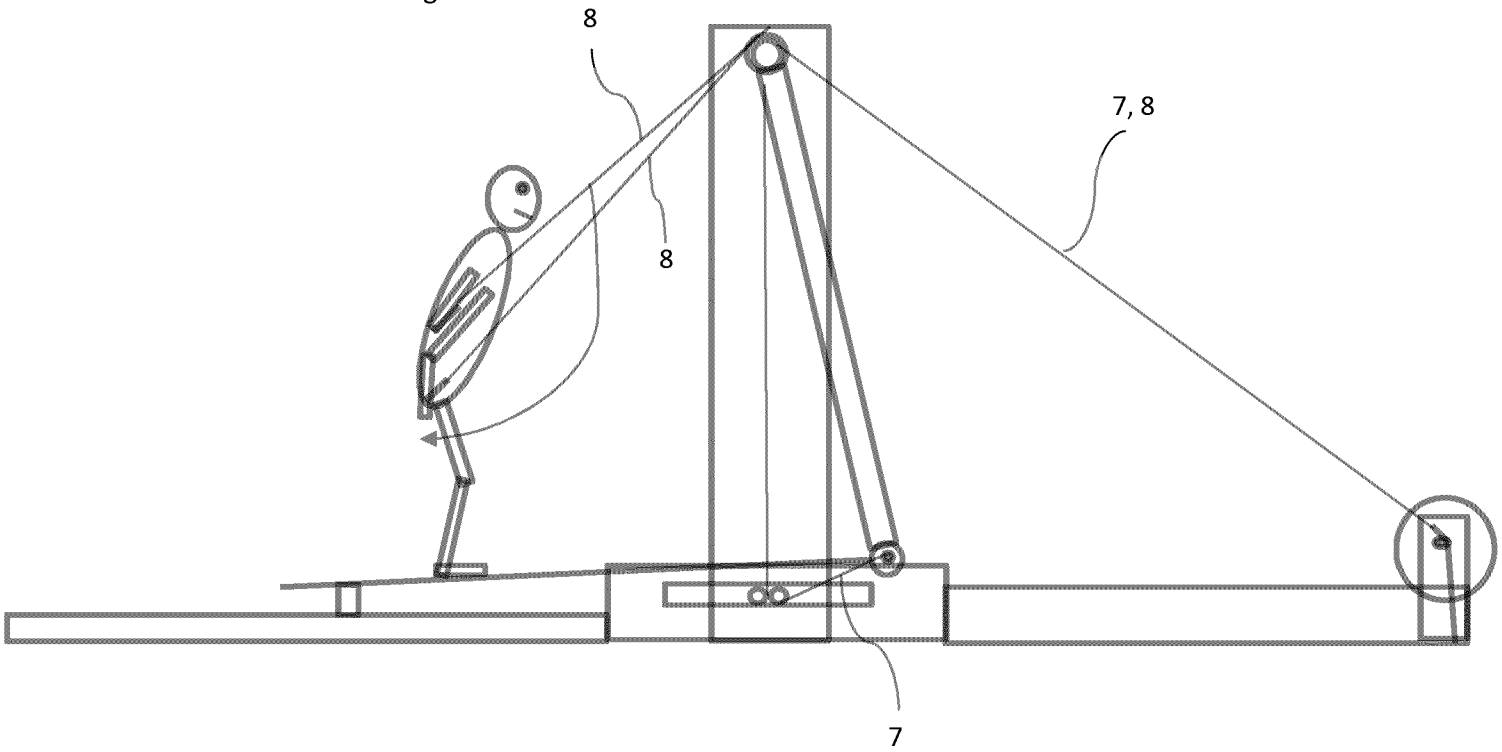
FIG. 7 shows an aspect of the invention from the side, when the practitioner is in the end of the poling movement.

The construction also allows, for example, to stand still on the skis 2 and drive the flywheel 14 by simply poling the pole handles 3. Another possibility is to drive the flywheel 14 by pivoting the skis 2 without moving the pole handles 3. Cords 7, 8, 10, are detachably connected to the driveshaft 17, which allows them to be disconnected. For example, the first cord 7 may be disconnected from the pendulate arms 19, to get a clean swing without any resistance from the movement of the skis as shown in FIGS. 5 and 6. This still gives the desired forward movement at the poling itself.

Figure 15:
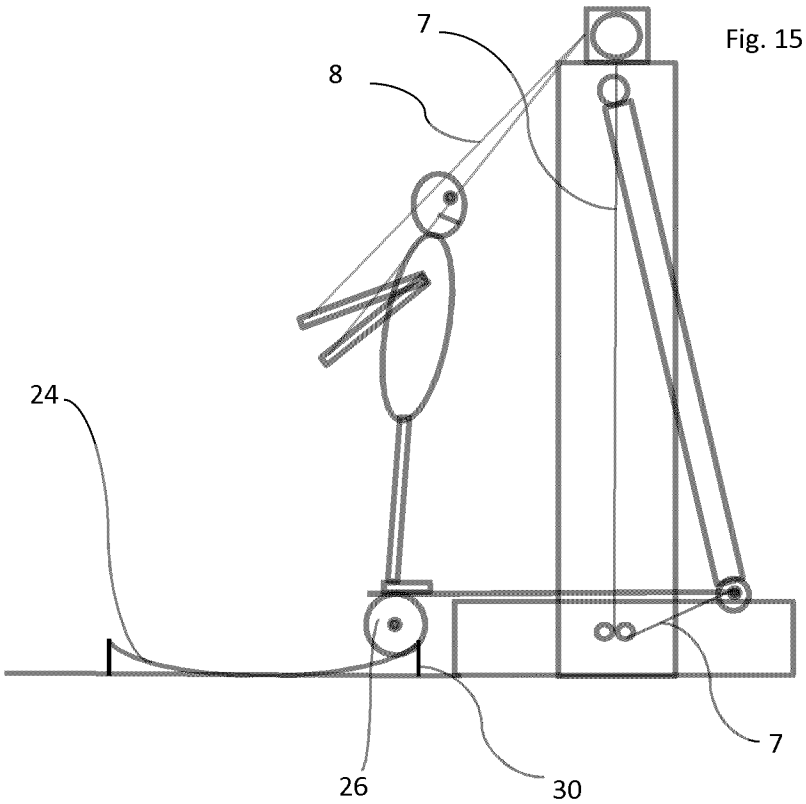
FIG. 15 shows a side view of an alternative aspect of the invention, where the resistance units is arranged on top of the frame and each cord has a separate adjustable resistance, flywheel attached.
Figure 16:
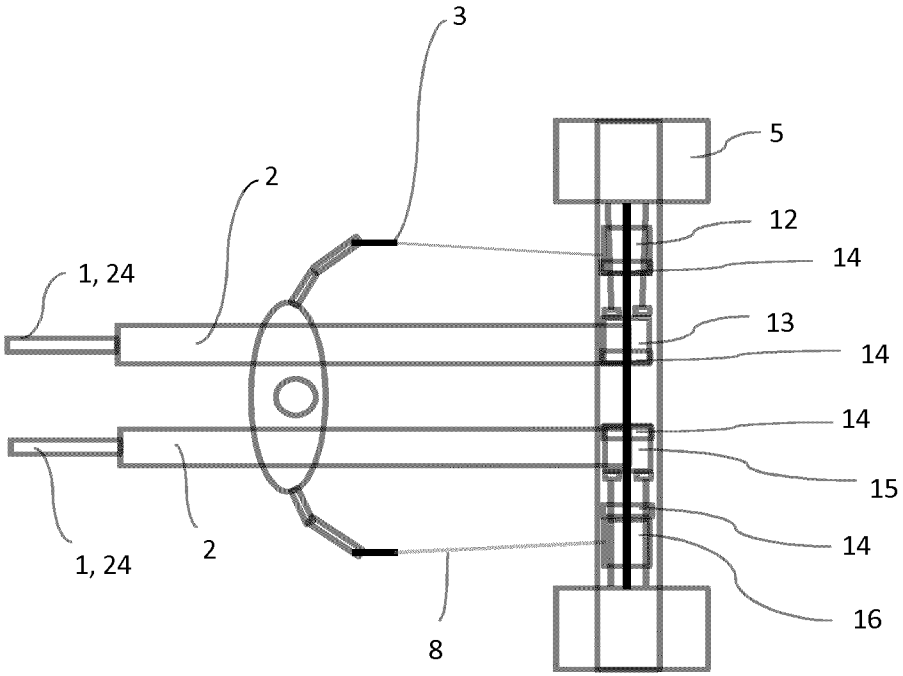
FIG. 16 shows a top view of the aspect in FIG. 15.
Figure 17:
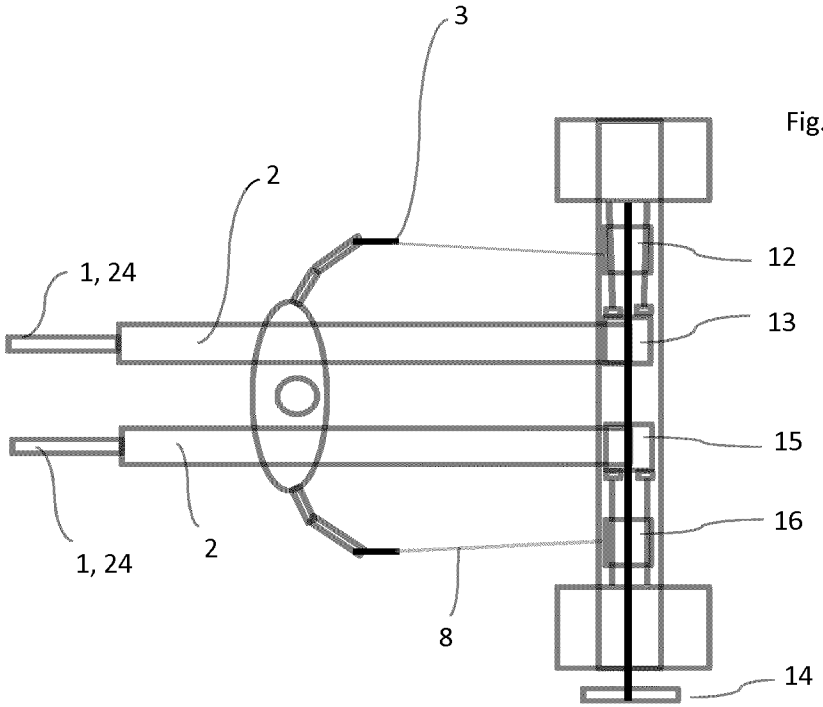
FIG. 17 shows a top view of the aspect in FIG. 15, where each resistance unit drives one common flywheel.

In an alternative embodiment to those described above in connection to FIGS. 1 to 11, the at least one resistance unit is arranged on top of the frame 5 as shown in FIGS. 15 to 17. The figures show a support part 30 as the one shown in FIG. 11, but it should be noted that it is merely an example; any support 1;29;30 part of the embodiments described in connection to FIGS. 1 to 11 can be combined with arranging the resistance unit on top of the frame. All features in the embodiments shown in FIGS. 1 to 11 can be applied to the embodiment, where the resistance unit is located on top of the frame except for the feature, when the first cords 7 are adjustably attached to the pendulate arms to enable a connection point between the resistance unit 3, 15 and each of the pendulate arms as shown in FIG. 3. This alternative device is less spacious.

The present invention is not limited to the embodiments disclosed but may be varied and modified within the scope of the following claims. For example, the resistance of the flywheel 14 can be varied by being connected to a magnetic brake, belt brake, back brake, air brake, water brake or any other type of brake. The resistance can then be connected to a computer that can be programmed so that the resistance is varied automatically. Skiing profiles similar to skiing on motion tracks in nature can be created by automating the device.

The invention claimed is:

1. A device for physical exercise comprising:

a pair of skis having a top side and a bottom side, a frame, two pendulate arms, each of the pendulate arms has an upper end rotatably connected to the frame about a rotational axis, and a lower end pivotably connected to one of the skis, and at least one resistance unit connected to the pendulate arms, at least one support part located below the skis respectively, and two movable elements connected to the bottom side of the skis respectively, and each of the movable elements are arranged to glide or role along the support part and wherein the device comprises a pair of first cords connecting the pendulate arms with the resistance unit, and each of the first cords is adjustable attached to one of the pendulate arms to enable a connection point between the cord and the pendulate arm to be raised and lowered along the pendulate arm.

2. The device according to claim 1, wherein the first cords extend from the connection point on pendulate arms, to a pair of first wheels mounted at a lower end on the frame and positioned vertically under the axis of the pendulate arms thereafter upwards to a pair of second wheels at an upper end of the pendulate arms and therefrom to the at least one resistance unit.

3. The device according to claim 2, wherein the attachments of the pair of first wheels on the frame are individually adjustable in height along a length of the frame.

4. The device according to claim 2, wherein the attachments of the pair of first wheels on the frame are individually laterally adjustable both behind and in front of a vertical position of the pendulate arm.

5. The device according to claim 1, wherein said at least one support part are two elongated support parts.

6. The device according to claim 5, wherein said elongated support parts front and rear end are height adjustable.

7. The device according to claim 1, wherein said at least one support part are gliding rails arranged with a longitudinal axis in parallel with a longitudinal axis of the skis.

8. The device according to claim 1, wherein a raiseable rail is pivotally attached to a front side of the skis, such that the rail can be raised from the skis when gliding or rolling over the support parts.

9. The device according to claim 1, wherein the first cords extend from the connection point on pendulate arms up between the pair of first wheels mounted at a lower end on the frame positioned vertically under said rotational axis thereafter upwards to the pair of second wheels via said rotational axis, and the first cords from the two pendulate arms then become a common cord continuing to the resistance unit.

10. The device according to claim 1, wherein the first cords extend from the connection point on the pendulate arms down to the pair of first wheels mounted at an upper end on the frame positioned vertically under said rotational axis thereafter downwards through second wheels at a bottom of frame and then continuing to the at least one resistance unit.

11. The device according to claim 1, wherein the first cords extend from the connection point on the pendulate arms up between the pair of first wheels mounted at an upper end of the frame positioned vertically under said rotational axis thereafter to the at least one resistance unit.

12. The device according to claim 1, wherein the device comprises a pair of pole handles, a pair of second cords connecting the pole handles to the at least one resistance unit.

13. The device according to claim 1, wherein the at least one resistance unit drives at least one flywheel, fan, centrifugal fan and/or magnetic resistance.

14. The device according to claim 1, wherein the first and/or second cords are detachable connected to the resistance unit.

* * * * *